United States Patent [19]

Nation et al.

[11] Patent Number: 4,739,133

[45] Date of Patent: Apr. 19, 1988

[54] ELECTRICAL SWITCHING APPARATUS

[75] Inventors: Melvin S. Nation, Elmhurst; Edward W. Wanatowicz, Jr., Elk Grove, both of Ill.

[73] Assignee: Illinois Tool Works Inc., Chicago, Ill.

[21] Appl. No.: 34,996

[22] Filed: Apr. 6, 1987

[51] Int. Cl.[4] ..... H01H 3/16; H01H 9/00; H01H 13/02

[52] U.S. Cl. ..... 200/61.62; 200/61.76; 200/159 R; 200/280; 200/302.2

[58] Field of Search ..... 200/16 B, 16 E, 61.62, 200/61.76–61.82, 159 R, 302.1, 302.2, 280, 281

[56] References Cited

U.S. PATENT DOCUMENTS

| | | | |
|---|---|---|---|
| 2,748,229 | 5/1956 | Block | 200/302.2 X |
| 2,779,833 | 1/1957 | Farison | 200/61.82 |
| 2,921,155 | 1/1960 | Basso | 200/61.82 |
| 3,115,559 | 12/1963 | Cass et al. | 200/61.89 |
| 3,244,829 | 4/1966 | Webb | 200/61.62 |
| 3,375,339 | 3/1968 | Schaber | 200/159 R |
| 3,393,281 | 7/1968 | Basso | 200/61.62 |
| 3,432,634 | 3/1969 | Basso | 200/159 R |
| 4,406,935 | 9/1983 | Montag et al. | 200/61.82 |
| 4,492,833 | 1/1985 | Malesko | 200/159 R X |

*Primary Examiner*—J. R. Scott

*Attorney, Agent, or Firm*—D. J. Breh; T. W. Buckman

[57] ABSTRACT

An electrical switching device for door actuated operation especially configured for conversion between grounded and non-grounded operation is disclosed. The device includes a housing including a stationary contact and a moveable contact. The moveable contact is actuated by a door operated actuator which moveable contact makes and breaks contact with the fixed contact and completes a circuit to ground through the housing. The moveable contact and fixed contact are configured to receive and cooperate with an insulation member insertable between the two contacts and an additional contact member insertable between the insulation member and the moveable contact to convert the switch to non-grounded operation.

15 Claims, 4 Drawing Sheets

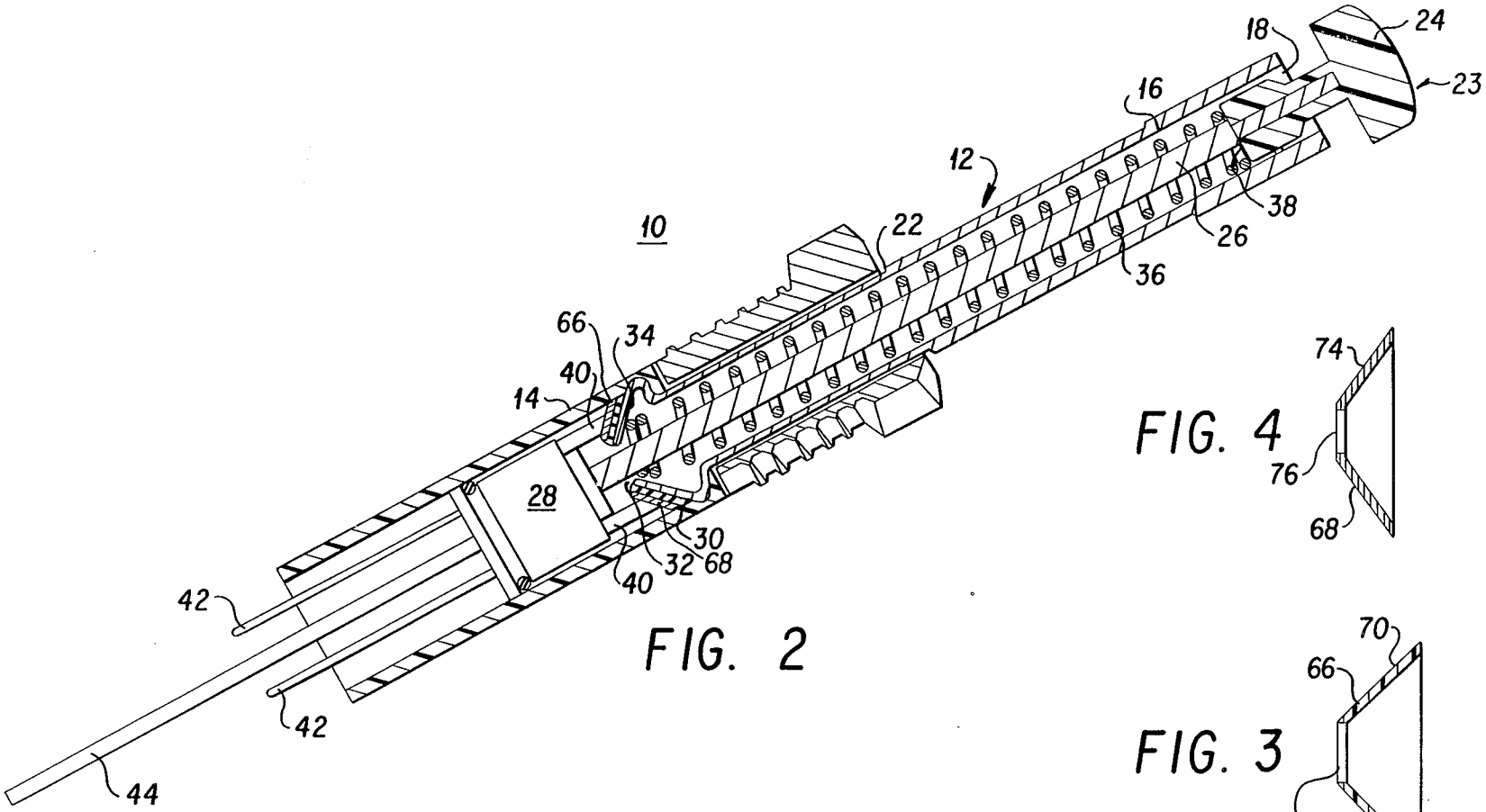
FIG. 2
FIG. 4
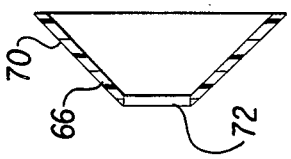
FIG. 3

ELECTRICAL SWITCHING APPARATUS

BACKGROUND OF THE INVENTION

The present invention is directed to an electrical switching apparatus particularly suited for door actuated operation and configured to facilitate conversion for grounded or non-grounded operation.

Numerous devices have long been available for door actuated operation, such as the devices disclosed and U.S. Pat. Nos. 2,921,155; 3,393,281; and 3,432,634 all by M. J. Basso; as well as 3,244,829 by G. L. Webb and 3,251,971 by R. W. Fraser.

For example, a device disclosed by Webb in U.S. Pat. No. 3,244,829 has become nearly an industry standard in many applications of door actuated devices associated with automotive applications, such as lighting circuits. The Webb device is a grounded operating switch, meaning that the supply of power to the lighting device is connected to ground through the switch to complete the circuit and effect illumination of the light bulb.

The Basso devices disclosed in the patents cited above provide a variety of door actuated switches particularly associated with the automotive industry. Basso's U.S. Pat. No. 3,393,281 provides a door actuated push-button switch which is usable for grounded or non-grounded applications. Proper selection of the particular terminals associated with that switch determine whether grounded or non-grounded operation is effected. Basso's U.S. Pat. Nos. 3,432,634 and 2,921,155 disclose self-adjusting features for switches of a door closure switch. Fraser's U.S. Pat. No. 3,251,971 likewise illustrates a self-adjusting feature for a door actuated switch.

There are two particular shortcomings of the prior art switches which are hereinabove discussed which are overcome by the present invention.

First, there is a need for a switch which can be, during its manufacture, easily established to be a grounded or a non-grounded operating switch. Such factory-determination of the mode of operation of the switch precludes confusion in installation of the switch in the field which could damage the electrical circuitry by connecting incorrect connectors for the particular mode of operation desired. Further, by having an easily converted switch, as is provided by the present invention, fewer special parts are needed to effect the determination of mode of operation of the switch, thus yielding greater economy and flexibility in its manufacture to accommodate the two basic types of switching operations encountered in field applications.

Second, a common problem among all of the prior art switches, especially in automotive applications, is the ingress of contaminants (particularly water) to the interior of the switch. Ingress of water to the interior of the switch in the area of the contacts of the switch frequently establishes a leakage path through the water contaminant from the movable contacts to the fixed contacts when the door is closed and the switch is in its open position. Such a leakage path produces at least two problems: (1) an electrical path is established where no such path is desired, resulting in possible inadvertent operation of the equipment controlled by the switch and depletion of the power source, generally a battery in automotive applications; and (2) a low level leakage current through the contaminant establishes conditions ripe for an ionizing process which can produce oxides on the respective terminals, thereby decreasing their effectiveness as electrical conductors with consequent decreases in effectiveness of the switching operations during subsequent actuations of the switch.

SUMMARY OF THE INVENTION

The invention is an electrical switching apparatus having a housing assembly with an axial bore therethrough, which housing assembly presents a fixed electrical contact substantially concentrically located within the bore for contributing to switching operation of the apparatus. An actuator means is captively situated within the bore and axially movable within the bore for actuating the apparatus. The actuator means is accessible for application of an actuating force at one end of the bore and accessible for electrical connection from outside the housing assembly at the other end of the bore. The actuator means further includes movable contact means responsive to application of the actuating force to make and break electrical contact with the fixed contact means within the bore.

Further, the invention includes sealing means for resisting the ingress of contaminants within the bore. In the preferred embodiment the sealing means comprise at least one seal assembly at each end of the bore made up of a seal carrier affixed to the actuator means and cooperating with the housing assembly to protect the bore from contaminants.

In the preferred embodiment of the present invention, the seal carrier includes a compression limiting flange construction depending from the seal carrier substantially adjacent the sealing member. The flange establishes a compression gap between the flange and the housing assembly so that the sealing member may experience maximum compressive displacement between the housing assembly and the seal carrier equal to the compression gap.

The preferred embodiment of the present invention further includes an electrically conductive mounting structure for grounding and installing the apparatus which is electrically communicative with the fixed contacts within the bore. Thus, in the preferred embodiment, the switching operation effected between the movable contacts and the fixed contacts is a grounded switching operation. The apparatus is configured to facilitate conversion from grounded to non-grounded switching operation by interposing an electrically insulative material between the fixed contacts within the bore and the movable contacts and further interposing between the electrically insulated material and the movable contacts a supplemental fixed contact structure to provide non-grounded switching operation in cooperation with the movable contacts.

It is, therefore, an object of this invention to provide an electrical switching apparatus particularly suited for door actuation which is sealed to resist ingress of contaminants to the interior of the apparatus.

A further object of this invention is to provide an electrical switching apparatus which is configured to facilitate conversion for grounded or non-grounded switching operation.

Further objects and features of the present invention will be apparent from the following specification and claims when considered in connection with the accompanying drawings illustrating the preferred embodiment of the invention.

DETAILED DESCRIPTION OF THE DRAWINGS

FIG. 2 is a schematic partial section view of the preferred embodiment of the present invention illustrating the conversion of the apparatus to non-grounded switching operation.

FIG. 3 is a section view of an electrically insulative insert utilized in conversion of the apparatus to non-grounded switching operation.

FIG. 4 is a section view of the supplemental fixed contact utilized in the conversion of the apparatus to non-grounded switching operation.

DETAILED DESCRIPTION OF THE INVENTION

Figures 1, 5:
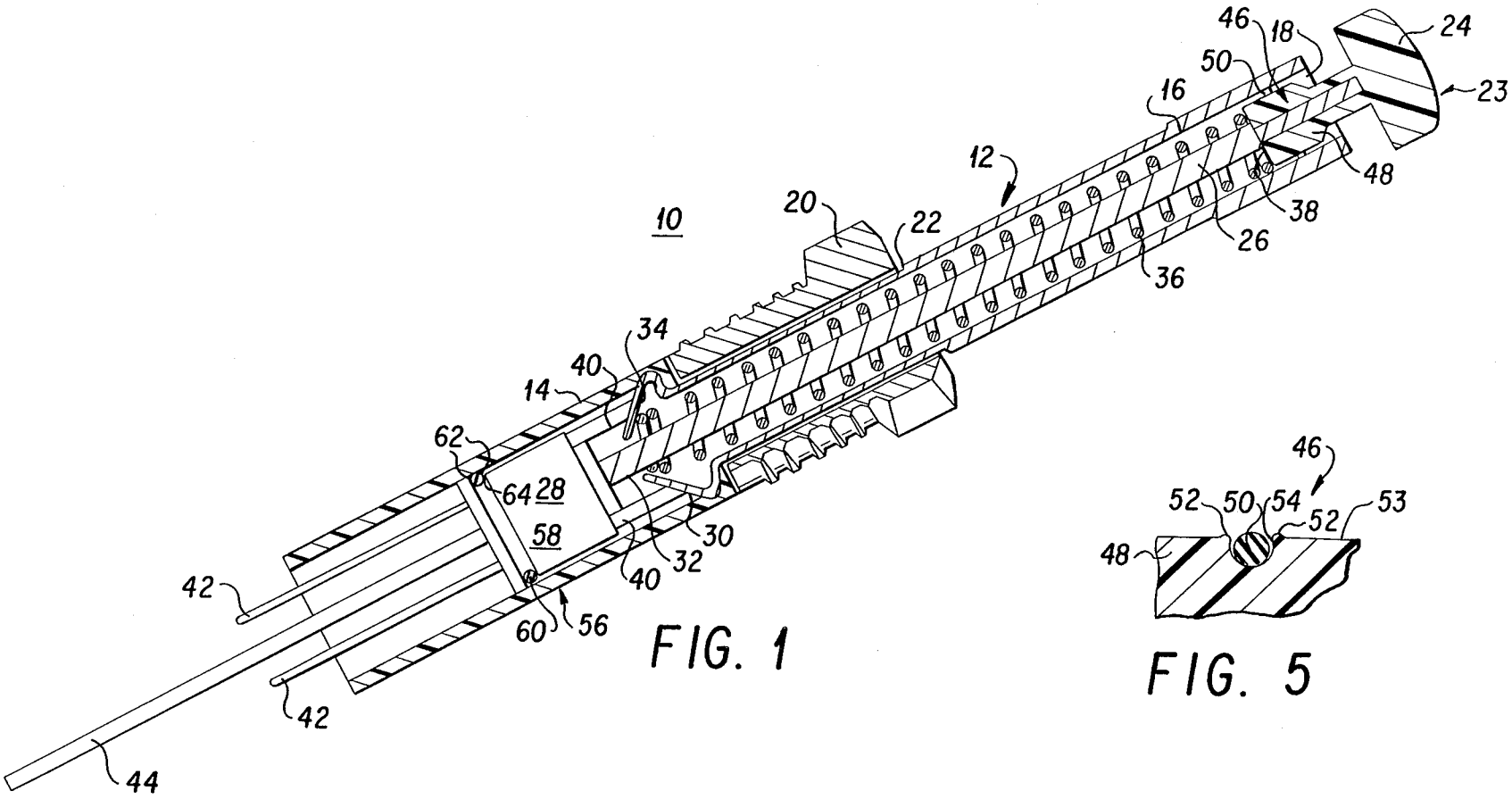
FIG. 1 is a schematic partial section view of the preferred embodiment of the present invention configured for grounded switching operation.
FIG. 5 is a section view of a portion of the sealing assembly of the apparatus.

For purposes of clarity, like elements will be assigned like reference numerals in the various figures.

In FIG. 1, an electrical switching apparatus 10 is shown having housing assembly 12. The housing assembly 12 is preferably comprised of a non-conductive receptacle 14 within which is affixedly received an electrically conductive insert 16. A bore 18 is established through the housing assembly 12. Further included in the housing assembly 12 is an electrically conductive mounting nut 20 which is electrically communicative with the electrically conductive insert 16 and is captively held upon the housing assembly 12 in some manner known in the art, such as by a shoulder 22 formed in the electrically conductive insert 16 to expand the diameter of the insert 16 beyond the inner-diameter of the mounting nut 20.

An actuator assembly 23 is captively situated within the bore 18. The actuator assembly 23 is comprised of an actuator knob 24 affixed to a shaft 26, which shaft 26 is affixed at its distal end to a terminal carrier 28.

The insert 16 is formed within the receptacle 14 to provide a fixed contact 30 which is substantially axially and concentrically oriented within the bore 18. The fixed contact 30 presents an aperture 32 through which the shaft 26 passes and presents a bearing surface 34 against which a bias spring 36 of the compression type is compressed between the bearing surface 34 and the face 38 of the actuator knob 24. In such manner the bias spring 36 biases the actuator knob 24 and, hence, the actuator assembly 23, toward a position whereby the fixed contacts 30 are in contact with movable contacts 40 which are carried upon the terminal carrier 28.

The movable contacts 40 are electrically connected through the terminal carrier 28 to electrical terminals 42 which are accessible externally of the housing assembly 12. An electrically insulative tail piece 44 is preferably provided depending from the terminal carrier 28 intermediate the electrical terminals 42 to preclude electrical shorting between the electrical terminals 42.

Integrally formed in the actuator knob 24 is a sealing assembly 46 which is preferably comprised of a seal carrier 48 and, carried thereon, a sealing member 50.

Referring to FIG. 5, a partial view of a portion of the preferred sealing assembly 46 is shown in section. The sealing member 50, preferably in the form of an O-ring or a similar sealing device is carried upon the seal carrier 48. Integrally formed in the seal carrier 48 are a pair of compression limiting protrusions 52 adjacent the channel 54 within which the sealing member 50 is retained.

Referring again to FIG. 1, the terminal carrier 28 has integrally formed therein a second sealing assembly 56 which is preferably comprised of a seal carrier 58 and a sealing member 60 carried thereon. The preferred sealing member 56 is similar in its construction to the sealing assembly 46 in that integral compression limiting protrusions 62 are formed in the seal carrier 58 adjacent a channel 64 in which the sealing member 60 is retained.

The compression limiting means 52 and 62 shall be discussed in connection with FIG. 5 for purposes of ease of understanding the invention. The compression limiting protrusions 52 extend above the level of the periphery 53 of the seal carrier 48 a distance less than the distance the outer limit of the sealing member 50 extends above the periphery 53 of the seal carrier 48. By such a structural arrangement the sealing member 50 may be compressed only a distance equal to the difference between the distance the outer periphery of the sealing member 50 extends above the periphery 53 of the seal carrier 48 and the distance the compression limiting protrusions 52 extend above the periphery 53 of the seal carrier 48. Careful selection of the distance the compression limiting protrusions 52 extend above the periphery 53 of the seal carrier 48 and the thickness of the sealing member 50 provide a precise structural determination of the amount of compression which will be experienced by the sealing member 50 when it is inserted within the bore 18.

As hereinbefore stated, the configuration of the electrical switching apparatus 10 shown in FIG. 1 accommodates grounded switching operation. In such operation, an electrical potential will be applied to one of the electrical terminals 42, thus providing electrical potential to one of the movable contacts 40 through the terminal carrier 28. When no actuating force is applied to the actuator knob 24, the bias spring 36 urges the movable contact 40 against the fixed contact 30 completing an electrical circuit therebetween. The fixed contact 30 is integrally formed from the electrically conductive insert 16 and is electrically communicative with the electrically conductive mounting nut 20. In such an arrangement, a path to ground is provided between the energized electrical terminal 42 to ground when the switching apparatus 10 is mounted in a grounded panel (not shown) through the associated energized movable contact 40, the fixed contact 30 and its integrally associated electrically conductive insert 16, through the mounting nut 20 to ground in the mounting panel (not shown).

Referring to FIG. 2, a schematic partial section view of the electrical switching apparatus 10 configured for non-grounded switching operation is shown. The electrical switching apparatus 10 is similar to the apparatus illustrated in FIG. 1 in that a housing assembly 12 is provided comprised of a non-conductive receptacle 14 and an electrically conductive insert 16. A bore 18 is established through the housing assembly 12. Further included in the housing assembly 12 is an electrically conductive mounting nut 20 which is captively held upon the housing assembly 12, such as by a shoulder 22 formed in the insert 16, as discussed hereinabove with respect to FIG. 1. An actuator assembly 23 is captively situated within the bore 18 and is comprised of an actuator knob 24 affixed to a shaft 26, which shaft 26 is affixed at its distal end to a terminal carrier 28.

The insert 16 is formed within the receptacle 14 to provide a fixed contact 30 which is substantially, axially and concentrically oriented within the bore 18. The fixed contact 30 presents an aperture 32 through which the shaft 26 passes and presents a bearing surface 34 against which a bias spring of the compression type is compressed between the bearing surface 34 and the face 38 of the actuator knob 24.

The movable contacts 40 are electrically connected through the terminal carrier 28 into electrical terminals 22 which are accessible externally of the housing assembly 12. An electrically insulative tail piece 44 is preferably provided depending from the terminal carrier 28 intermediate the electrical terminals 42 to preclude electrical shorting there between.

The conversion of the apparatus 10 for non-grounded switching operation is accomplished by insertion of an electrically insulative spacer 66 between the movable contacts 40 and the fixed contacts 30 and insertion of an electrically conductive supplemental fixed contact 68 between the insulative spacer 66 and the movable contact 40.

The structure of the electrical insulative spacer 66 is shown in section in FIG. 3. The electrical insulative spacer 66 is generally formed in a truncated conical structure, the wall 70 of which is complementary in shape to the shape of the fixed contacts 30 of the apparatus 10. An aperture 72 is provided which is substantially coterminous with the aperture 32 of the fixed contacts 30 when the insulative spacer 66 is installed.

In FIG. 4, the electrically conductive supplemental fixed contact 68 is shown to have a substantially truncated conical structure, the wall 74 of which is substantially complementary to the insulative spacer 66. An aperture 76 is provided therethrough, which aperture 76 is situated to be substantially coterminous with the aperture 72 of the insulative spacer 66 when the supplemental fixed contact 68 is installed in the apparatus 10.

When the apparatus 10 is converted for non-grounded switching operation, as illustrated in FIG. 2, the supplemental fixed contact 68 is electrically insulated from the fixed contact 30 by the insulative spacer 66. Thus, the path to ground described hereinabove with respect to FIG. 1 from the electrical terminal 42 through the movable contacts 40, the fixed contacts 30, the electrically conductive insert 16, and the mounting nut 20 is interrupted by the insulative spacer 66. However, since the supplemental fixed contact 68 is electrically conductive, when no actuating force is applied to the actuator knob 24, and the bias spring urges the movable contacts 40 toward the fixed contacts 30, the movable contacts are, in the configuration shown in FIG. 2, urged against the supplemental fixed contact 68. In such manner, the movable contacts 40 are electrically in common through the electrically conductive supplemental fixed contact 68.

Thus, in the configuration illustrated in FIG. 2, an electrical potential can be applied to one of the electrical terminals 42 and an electrical circuit will be completed with the other of the electrical terminals 42 through a first movable contact 40, through the supplemental fixed contact 68, through the other movable contact 40 and thence to the other electrical terminal 42 when the actuator is undepressed and the bias spring 36 urges the actuator assembly 23 to the right in FIG. 2 to effect contact of the movable contacts 40 with the supplemental fixed contact 68. Application of an actuator force to the actuator knob 24 sufficient to move the actuator assembly 23 to the left in FIG. 2 will disengage the movable contacts 40 from the supplemental fixed contact 68 thereby interrupting electrical continuity between the two electrical terminals 42.

Figure 6:
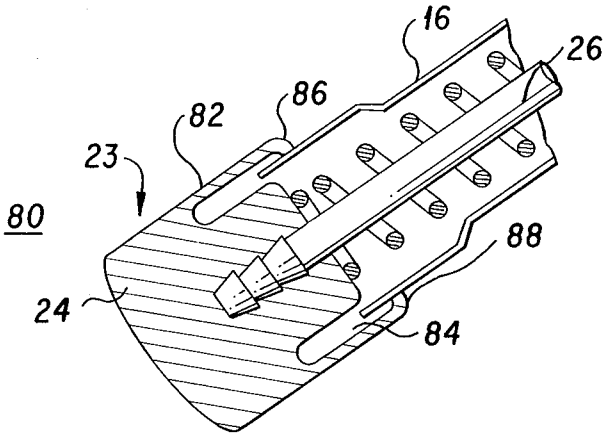
FIG. 6 is a schematic partial section view of an alternate embodiment of the sealing assembly for the actuator assembly.

Referring to FIG. 6, a schematic partial section view of an alternate embodiment of the sealing assembly 80 for the actuator assembly 23 is shown.

For purposes of facilitating understanding of the invention, similar elements will be identified by the same reference numerals in the various drawings.

In FIG. 6, an actuator assembly 23 is shown having an actuator knob 24 affixed to a shaft 26 inside an electrically conductive insert 16.

The actuator knob 24 has an annular skirt 82 and an adjacent annular well 84. The free end 86 of the annular shirt 82 is bent inwardly to form an annular lip 88. The inner periphery of the annular lip 88 is in substantially mating relationship with the outer periphery of the electrically conductive insert 16 so that, as the actuator knob 24 is moved during actuation, the annular lip 88 slidingly sealing engages the outer surface of the electrically conductive insert 16, thereby impeding the ingress of contaminants to the interior of the switch therethrough.

The annular well 84 is appropriately wide and appropriately deep to receive the electrically conductive insert 16 therein when the actuator knob 24 is depressed.

Figure 7:
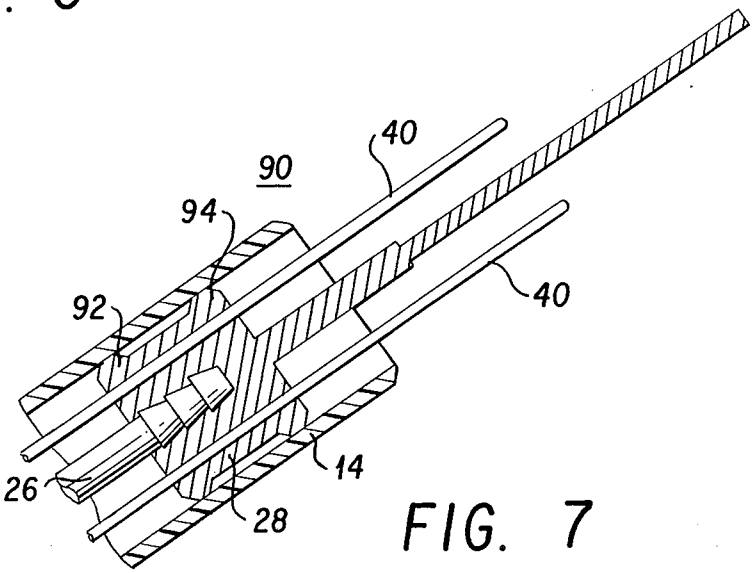
FIG. 7 is a schematic partial section view of an alternate embodiment of the sealing assembly for the terminal carrier.

FIG. 7 illustrates, in a schematic partial section view, an alternate embodiment 90 of the sealing assembly for the terminal carrier 28.

In FIG. 7, the terminal carrier 28 is affixed to the shaft 26 within the non-conductive receptacle 14 which is in the form of a shroud surrounding the terminal carrier 28. The movable contacts 40 are fixedly situated in the terminal carrier 28.

Integrally formed in the terminal carrier 28 are preferably two annular protrusions 92 and 94. Of course, a single annular protrusion, or more than two annular protrusions may be employed. However, the preferred number of annular protrusions is two.

The outer peripheries of the annular protrusions 92, 94 are each in substantially wiping relationship with the inner periphery of the non-conductive receptacle 14 thereby impeding the ingress of contaminants to the interior of the switch therethrough.

Alternatively, the non-conductive shroud-like receptacle 14 may be constructed of compressible material such as silicone, and appropriately sized to squeezingly engage the terminal carrier 28. With such a construction the annular protrusions 92, 94, or either of the annular protrusions 92, 94, should only one be employed, would be impressed into the inner wall of the non-conductive receptacle 14. An appropriate choice of how tightly the non-conductive shroud-like receptacle 14 squeezes the terminal carrier 28 will allow an excellent sealing relationship to be established by the compressive fit between the non-conductive receptacle 14 and at least one of the annular protrusions 92, 94 while still permitting axial movement of the terminal carrier 28 within the non-conductive receptacle 14 in response to movement of the actuator knob 24.

Figure 8:
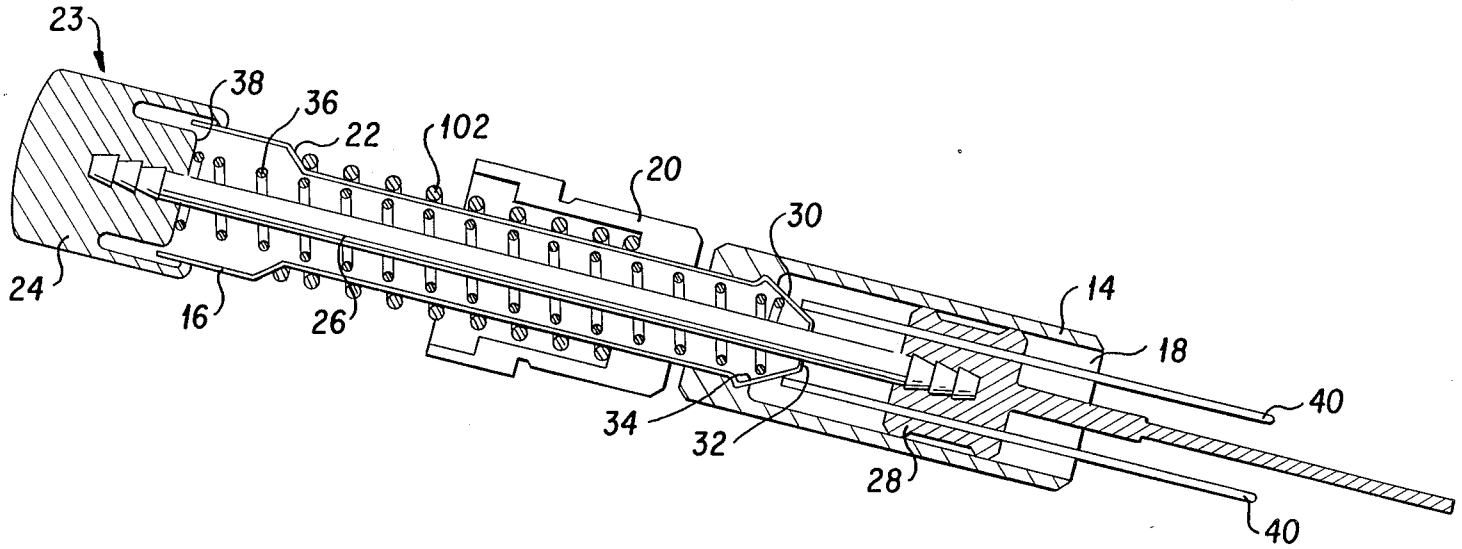
FIG. 8 is a schematic partial section view of an alternate embodiment of the present invention configured for grounded switching operation and providing a continually adjusting actuation throw.

FIG. 8 illustrates, in a schematic partial section view, an alternate embodiment 100 of the present invention configured for grounded switching operation and providing a continually adjusting actuation throw.

In FIG. 8, an electrically conductive insert 16 is affixed within a non-conductive receptacle 14 in a manner creating a common bore 18. An actuator assembly 23 including an actuator knob 24 affixed to a shaft 26 and an associated bias spring 36 are situated within the bore 18. The shaft 26 extends through an aperture 32 in the electrically conductive insert 16 and is affixed to a terminal carrier 28. The electrically conductive insert 16 is of a reduced diameter in the vicinity of the aperture 32, thereby providing a bearing surface 34. The bias spring 36 is compressively retained between the bearing surface 34 and the face 38 of the actuator knob 24. Movable contacts 40 affixed within the terminal carrier 28 are biased against an annular fixed contact 30, integrally formed in the electrically conductive insert 16, by the bias spring 36. Application of an actuating force to depress the actuator knob 24 compresses the bias spring 36 and moves the movable contacts 40 out of contact with the fixed contact 30.

An electrically conductive mounting nut 20 is captively retained about the electrically conductive insert 16 by a housing bias spring 102. Housing bias spring 102 is compressively maintained between mounting nut 20 and shoulder 22 formed in the electrically conductive insert 16.

The embodiment illustrated in FIG. 8 is configured to continually adjust to accommodate variable clearances which may occur between a door (not shown) which bears against the actuator knob 24 and a door jamb (not shown) into which the mounting nut 20 is threaded. The housing bias spring 102 ensures that the actuator knob 24 and its associated door are in contact when the door is in a closed position for a range of distances from the door jamb. The housing bias spring 102 also performs an overtravel function when the actuator knob 24 is fully depressed against the electrically conductive insert 16.

It is to be understood that, while the detailed drawings and specific examples given describe preferred embodiments of the invention, they are for the purpose of illustration only, that the apparatus of the invention is not limited to the precise details and conditions disclosed and that various changes may be made therein without departing from the spirit of the invention which is defined by the following claims.

We claim:

1. An electrical switching apparatus configured to facilitate conversion for grounded or non-grounded operation; said apparatus comprising a housing assembly having an axial bore therethrough, said housing assembly including electrically conductive mounting means for groundingly installing said apparatus, said housing assembly further presenting fixed electrical contact means substantially concentrically axially located within said bore for providing an electrical path to ground through said mounting means; and actuator means captively situated within said bore and axially movable within said bore for actuating said apparatus, said actuator means being accessible for application of an actuating force at a first end of said bore and being accessible for electrical connection from the exterior of said housing assembly at a second end of said bore, said actuator means including movable contact means responsive to said actuating force to make and break electrical contact with said fixed contact means, said fixed contact means and said movable contact means adapted to cooperate with means insertable between said fixed contact means and said movable contact means for converting said switching apparatus for non-grounded switching operation, said means for converting including insulation means insertable between said fixed contact means and said movable contact means for insulating said movable contact means for grounding through said fixed contact means through said mounting means, and said means for converting further including supplemental fixed contact means insertable between said insulation means and said movable contact means for effecting non-grounded switching operation in cooperation with said movable contact means.

2. An electrical switching apparatus as recited in claim 1 wherein said apparatus further comprises at least one sealing means for resisting ingress of contaminants to said bore.

3. An electrical switching apparatus as recited in claim 2 wherein said at least one sealing means comprises one sealing means generally located at each end of said bore.

4. An electrical switching apparatus as recited in claim 3 wherein at least one of said sealing means comprises a seal carrier affixed to said actuator means and a sealing member carried upon said seal carrier, said sealing member being compressed between said housing assembly and said seal carrier.

5. An electrical switching apparatus as recited in claim 4 wherein each said seal carrier includes compression limiting means for limiting compression of said sealing member, said compression limiting means comprising at least one flange depending from said seal carrier substantially adjacent said sealing member toward said housing assembly defining a compression gap between said flange and said housing assembly, whereby said sealing member may experience maximum compressive displacement between said housing assembly and said seal carrier equal to said compression gap.

6. An electrical switching apparatus as recited in claim 2 wherein said at least one sealing means comprises a skirt means extending from said actuator means in annular relationship surrounding said housing means for a distance along said housing means, said skirt means being configured for a substantially wiping relationship with said housing means.

7. An electrical switching apparatus as recited in claim 2 wherein said housing means includes a compressible shroud means portion surrounding said movable contact means; said at least one sealing means comprising said movable contact means and said compressible shroud means compressively engaged and cooperating to resist ingress of contaminants into said bore.

8. A door activated, electrical switching apparatus comprising a housing assembly having an axial bore therethrough, said housing assembly presenting fixed electrical contact means substantially concentrically axially located within said bore for contributing to switching operation of said apparatus, and actuator means captively situated within said bore and axially movable within said bore for actuating said apparatus, said actuator means being accessible for application of an actuating force at a first end of said bore and being accessible for electrical connection from the exterior of said housing assembly at a second end of said bore, said actuator means including movable contact means responsive to said actuating force to make and break electrical contact with said fixed contact means, and sealing means generally located at each end of said bore for resisting ingress of contaminants into said bore.

9. A door activated electrical switching apparatus as recited in claim 8 wherein at least one of said sealing means comprises a seal carrier affixed to said actuator means and a sealing member carried upon said seal carrier, said sealing member being compressed between said housing assembly and said seal carrier.

10. A door activated electrical switching apparatus as recited in claim 9 wherein each said carrier includes compression limiting means for limiting compression of said sealing member, said compression limiting means comprising at least one flange depending from said seal carrier substantially adjacent said sealing member toward said housing assembly defining a compression gap between said flange and said housing assembly, whereby said sealing member may experience maximum compressive displacement between said housing assembly and said seal carrier equal to said compression gap.

11. A door activated electrical switching apparatus as recited in claim 8 wherein said housing assembly further includes electrically conductive mounting means for groundingly installing said apparatus; said making and breaking of electrical contact effecting grounded switching operation, said apparatus being configured to facilitate conversion from grounded to non-grounded operation by interposing insulation means between said fixed contact means and said movable contact means for insulating said movable contact means from grounding through said fixed contact means through said mounting means, and by interposing supplemental fixed contact means between said insulation means and said movable contact means for effecting non-grounded switching operation in cooperation with said movable contact means.

12. A door activated electrical switching apparatus as recited in claim 11 wherein said at least one sealing means comprises a skirt means extending from said actuator means in annular relationship surrounding said housing means for a distance along said housing means, said skirt means being configured for a substantially wiping relationship with said housing means.

13. A door activated electrical switching apparatus as recited in claim 11 wherein said housing means includes a compressible shroud means portion surrounding said movable contact means; said sealing means at one end comprising said movable contact means and said compressible shroud means compressively engaged and cooperating to resist ingress of contaminants into said bore.

14. A door activated electrical switching apparatus as recited in claim 8 wherein said at least one sealing means comprises a skirt means extending from said actuator means in annular relationship surrounding said housing means for a distance along said housing means, said skirt means being configured for a substantially wiping relationship with said housing means.

15. A door activated electrical switching apparatus as recited in claim 8 wherein said housing means includes a compressible shroud means portion surrounding said movable contact means; said sealing means at one end comprising said movable contact means and said compressible shroud means compressively engaged and cooperating to resist ingress of contaminants into said bore.

* * * * *